United States Patent [19]

Oshima et al.

[11] 4,365,126

[45] Dec. 21, 1982

[54] GAS CIRCUIT BREAKER

[75] Inventors: Masabumi Oshima; Haruo Honda, both of Hitachi; Takeshi Takahashi, Hitachiota, all of Japan

[73] Assignee: Hitachi, Ltd., Tokyo, Japan

[21] Appl. No.: 97,696

[22] Filed: Nov. 27, 1979

[30] Foreign Application Priority Data

Dec. 1, 1978 [JP] Japan ..... 53-147940

[51] Int. Cl.[3] ..... H01H 33/28

[52] U.S. Cl. ..... 200/144 AP; 200/148 R; 200/148 F

[58] Field of Search ..... 200/148 R, 148 F, 144 AP

[56] References Cited

U.S. PATENT DOCUMENTS 4,054,765 10/1977 Peek et al. ..... 200/148 F
4,096,367 6/1978 Peek et al. ..... 200/148 R
4,101,748 7/1978 Meyer et al. ..... 200/144 AP

FOREIGN PATENT DOCUMENTS 675895 5/1939 Fed. Rep. of Germany ... 200/148 F
517623 2/1940 United Kingdom ..... 200/148 F

*Primary Examiner*—Robert S. Macon
*Attorney, Agent, or Firm*—Antonelli, Terry & Wands

[57] ABSTRACT

A center shaft of a swing lever, connected to a moving contact of a main interrupting unit, is supported by hollow bearings. The center shaft is provided with an engaging portion which is positioned in the hollow space of the hollow bearing and therein connected to a rotating shaft of which the force is partially exerted on a moving contact of a closing resistor device. Therefore, if the gas circuit breaker does not need the closing resistor device, the rotating shaft may be removed. For the gas circuit breaker requiring the closing resistor device, the rotating shaft may be inserted into the hollow bearings. For both cases, the gas circuit breaker is thus able to take the same fundamental construction.

7 Claims, 5 Drawing Figures

GAS CIRCUIT BREAKER

BACKGROUND OF THE INVENTION

The present invention relates to gas circuit breakers, and particularly to the improvement in an operating force transmitting mechanism for transmitting an operating force to a breaker unit.

A gas circuit breaker used in a extra-high voltage system is provided with a closing resistor device for restricting a surge voltage upon closing. This closing resistor device is electrically connected in parallel with a main interrupting unit, and formed of a series connection of resistors and resistor contacts. The resistor contacts are closed before the main contacts are closed, to permit the resistors to be placed in a circuit. That is, the resistor contacts are "preinserted" to restrict a surge voltage upon closing the circuit and the resistor contacts are opened before the contact is opened.

To easily adjust such a operating characteristic as required in the closing resistor device, the main interrupting unit and a driving unit are combined into one common unit to open and close the resistance contacts mechanically. For this, a mechanism for controlling the resistor contacts is branched from part of the operating force transmitting mechanism which connects moving contact of the main interrupting unit and the operating device.

The gas circuit breakers with and without the closing resistor device have each hitherto been designed and manufactured separately. In common gas circuit breakers, however, the number of series-connected interrupting units of the same structure are increased for higher voltages used. Therefore, if the circuit breaker unit can be standardized, irrespective of whether it has the closing resistor device or not, it will be very advantageous in design and manufacture.

SUMMARY OF THE INVENTION

An object of the present invention is to provide a gas circuit breaker in which the closing resistor device can be installed with ease.

Another object of the present invention is to provide a gas circuit breaker capable of simultaneously and commonly charging gas into the porcelain of the interrupting unit and of the closing resistor device.

The present invention is arranged in consideration of the fact that a lever moving in a swing manner exists in the operating force transmitting mechanism for transmitting an operating force from the operation device to the moving contact of the interrupting unit. This lever is, for example, of L-shape and thus used for increasing or amplifying the stroke or force, respectively, by changing lever ratio or for changing the direction of force. Moreover, this lever has a center shaft for effecting a swing movement at its free end and this center shaft is supported slidably. In the present invention, this center shaft is supported by hollow bearings and engaged into a rotating shaft through the hollow space of the hollow bearing. This rotating shaft serves to transmit part of the force of the center shaft for opening and closing operation of the closing resistor device.

DETAILED DESCRIPTION OF THE PREFERRED EMBODIMENTS

Figure 1:
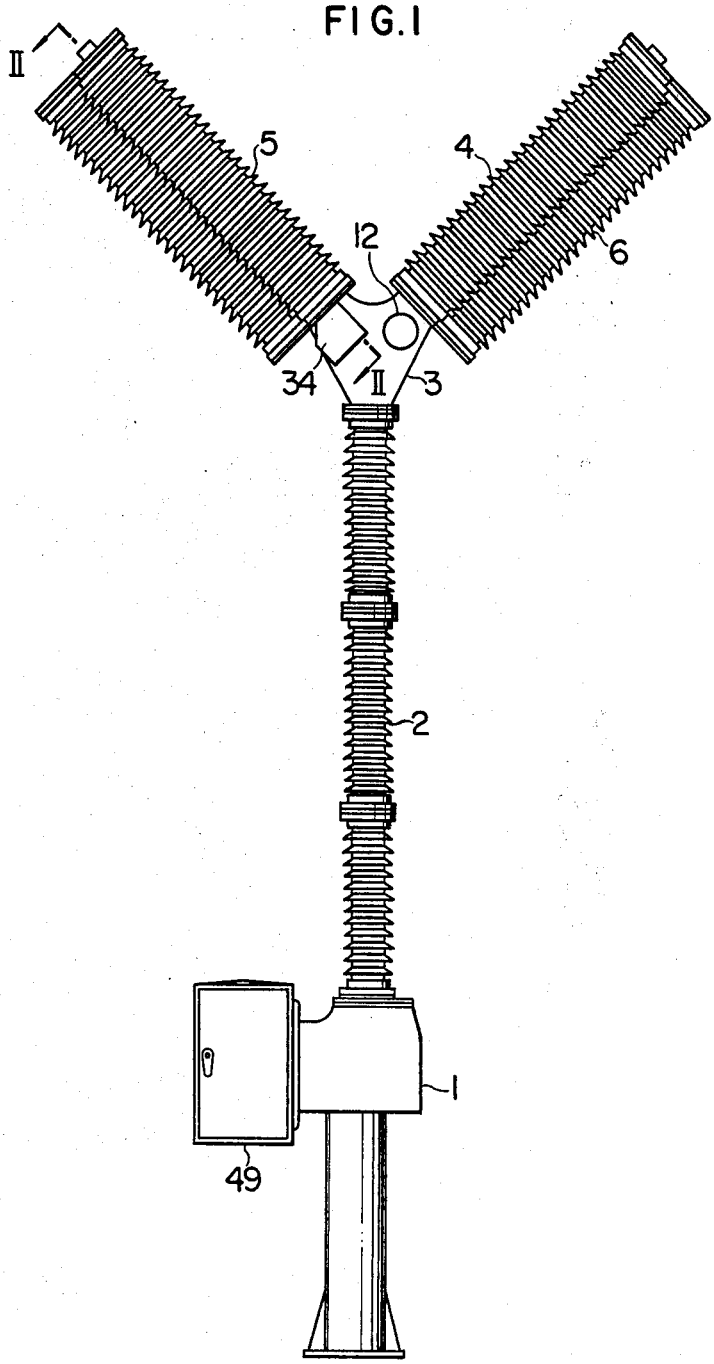
FIG. 1 is a front view of an embodiment of the live tank type gas circuit breaker according to the present invention.

FIG. 1 shows an external appearance of a live tank type gas circuit breaker. Above a support 1 there are shown a plurality of supporting porcelain tubes 2 connected in series and on the top of these supporting porcelain tubes is fixed a mechanism housing 3. The mechanism housing 3 are mounted with a pair of main interrupting units 4, a pair of closing resistor devices 5 and a pair of voltage grading capacitor devices 6, in which case the main interrupting unit 4 and the closing resistor device 5 are arranged at approximately the same level. These devices 4, 5 and 6 on the left and right side of the mechanism housing 3 are different in the mounting direction but of the same-structure unit.

In this live tank type gas circuit breaker, the supporting porcelain tubes 2, the mechanism housing 3, the main interrupting unit 4, the closing resistor device 5 and the voltage grading capacitor device 6 are individually or wholly made airtight in order to confine therewithin the SF6-gas or the like used for extinction of arc and for insulation.

Within the supporting porcelain tubes 2 is placed an insulating operation rod, which serves to transmit the operation force from an operation device 49 to moving contacts of the main interrupting units 4 and which forms one of the elements constituting an operation force transmission mechanism.

Figure 2:
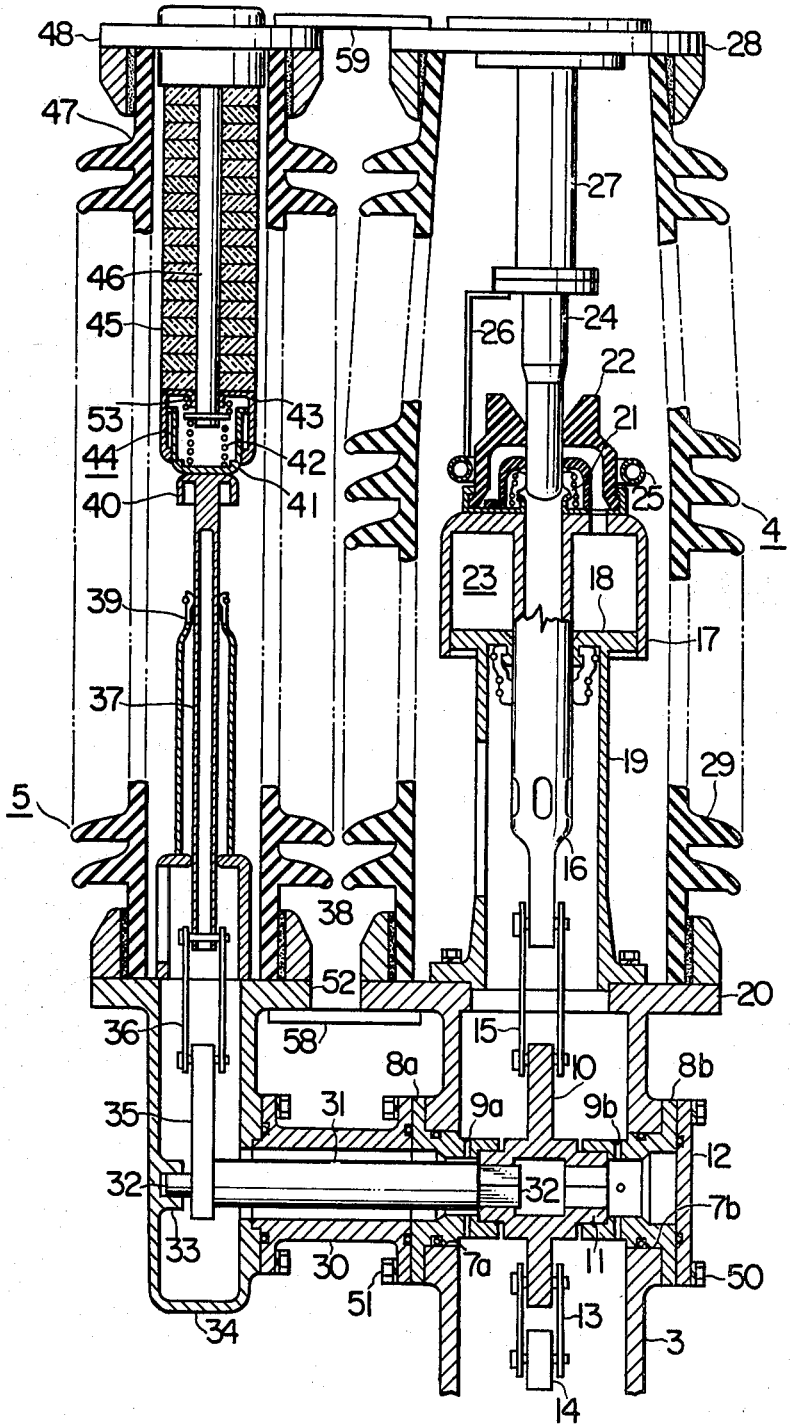
FIG. 2 is an enlarged diagram of the cross-section taken along line II—II in FIG. 1.

FIG. 2 shows a cross-sectional view taken along line II—II in FIG. 1. The voltage grading capacitor device 6, although not shown, is electrically connected in parallel with the main interrupting unit 4 so that voltages applied across open contacts of each interrupting unit 4 are equal.

Figure 3:
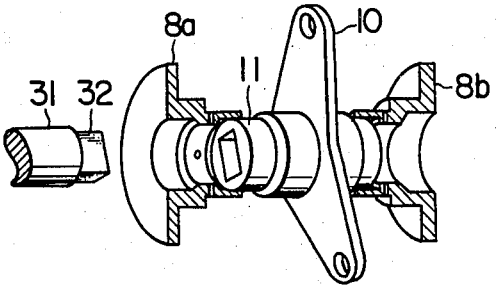
FIG. 3 is a perspective view of a main part of FIG. 2.

The mechanism housing 3 includes an L-shaped lever 10 with a center shaft 11 which, as shown in FIG. 3, is swingably supported between the opposite ends of hollow bearings **8*a* and 8*b* which are fitted into apertures 7*a* and 7*b* in such a manner as to remain airtight, with the apertures 7*a*, 7*b* being bored through the side walls of the mechanism housing 3. The space within the hollow bearing 8*b* communicates with the inside of the housing 3 through a small aperture 9*b*, and the right end of the hollow bearing 8*b* is sealed airtight by an end lid 12. The end lid 12, although not shown in detail, can be removed by releasing bolts 50. The hollow bearing 8*a* is connected at its left end to the right end of a tube 30, which can be disconnected from the housing 3 by releasing bolts 51, and is attached at its left end with the closing resistor device 5. As will be described later, opening and closing operation of the interrupting unit 4 is performed by the swing motion of the L-shaped lever 10, and part of the force from the lever 10 serves for the opening and closing operation of the closing resistor device 5. For this, the center shaft 11 is formed a through hole, the inside wall of which is, for example, of a rectangular shape in cross-section. A rotating shaft 31 placed in the tube 30 has, for example, a square cylinder 32 the cross-section of which coincides with the inside wall of the center shaft 11. This square cylinder 32 is engaged with the inner wall of the center shaft 11, so that the turning effect of the L-shaped lever 10 is transmitted to the rotating shaft 31. The left end of the tube 30 is fastened to a mechanism casing 34 with the airtightness maintained. To a flange 52 of the mechanism casing 34 is secured one end of a porcelain tube 47, the inside of which communicates with the inside of the mechanism housing 3 through the mechanism casing 34, the inner space of the tube 30 and a small aperture 9***a*. The mechanism casing 34 includes a bearing 33, into which the left end of the rotating shaft 31 is fitted rotatably, a lever 35 being secured to the left end of the shaft 31. Therefore, if an insulating operation bar 14 is driven by the operation device 49, the L-shaped lever 10 as shown in FIG. 3 is turned through a link 13. Thus, a moving contact 21 of the interrupting unit 4 is driven through a link 15 and also a moving contact 40 of closing resistor device 5 is driven through the rotation of the rotating shaft 31 by the rotation of the L-shaped lever 10. Since the small apertures 9*a* and 9*b* are bored through the hollow bearings 8*a* and 8*b*, respectively, the closing resistor device 5 does not need an exclusive SF6-gas charging valve. When SF6-gas is charged into the mechanism housing 3, it is also simultaneously fed into the porcelain tube 47. In this sense, the hollow bearings 8*a* and 8*b* serve to help connecting the operating force transmission mechanism to the closing resistor device 5 and communicating the gas to the closing resistor device 5.

The link 15, connected to the output end of the L-shaped lever 10, is connected to a center shaft 16 of a cylinder 17 which forms a compressor with a piston 18 slidably engaging therewith to form a chamber 23. The piston 18 is fastened by a supporting leg 19 to a flange 20 integral with the mechanism housing 3. The cylinder 17 is securely attached with an insulating nozzle 22 which serves to conduct the gas compressed within the chamber 23. Within the insulating nozzle 22 is mounted the moving contact 21 so as to be in contact with a fixed contact 24. Arc generated upon opening the connection between the contacts is extinguished by blast of gas conducted through the insulating nozzle 22. One example of such a main interrupting unit is disclosed in U.S. Pat. No. 3,909,572. The fixed contact 24 is fastened to an end lid 28 of a porcelain tube 29 through a conductor 27.

On the other hand, to the lever 35 are connected a moving conductor 37 and a movable resistance contact 40 through a link 36. The moving conductor 37 is operationally guided by a guide 38 which is fixed to the flange 52 integral with the mechanism casing 34. A current collector 39, fixed to the guide 38, is electrically connected between the movable conductor 37 and the flange 52. A fixed-side resistance contact 41, opposing to the movable resistance contact 40, is electrically connected to one end of a group of piled resistors 45. To an end lid 48 for sealing the top end of the porcelain tube 47, is fastened one end of an insulating rod 46, which is inserted into the hollow space of the resistors 45 consisting of piled doughnut-shaped elements. Between the other end of the insulating bar 46 and the other end of the resistor 45, there is disposed an outer cylinder 43 and a spring 53 which urges the resistor elements 45 to be passed therebetween and which fixes the outer cylinder 43 in position. Into the outer cylinder 43 is slidably fitted the fixed-side resistor contact 41, and between the opposite walls thereof there is a chamber 44. This chamber 44 has a volume as illustrated, by the overstroke after contact between the contacts 40 and 41, and exerts dashpot action on the fixed-side resistor contact 41 when the moving resistor contact 40 separates therefrom, so that the fixed-side resistor contact 41 is made to extremely slowly follow the contact 40 as compared with the separating speed of the moving resistor contact 40. When the fixed-side resistor contact 41 reaches the final position by a spring 42, the chamber 44 comes to have a minimum volume. Such dynamic characteristic adjusting means of the fixed-side resistor contact 41 allows the contacts 40 and 41 to be in contact with each other before the contacts 21 and 24 come in contact with each other, and the contacts 40 and 41 to separate from each other before the contacts 21 and 24 are separated. Since the closing resistor device 5 is electrically connected in parallel with the main interrupting unit 4 by conductor 58 and 59, the above operation satisfies the dynamic characteristic for the closing resistor device 5.

Figure 4:
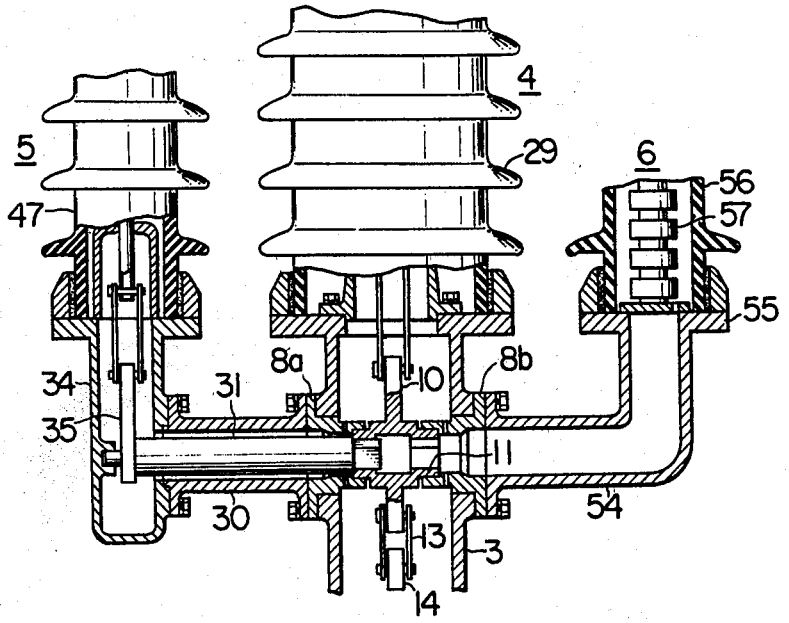
FIGS. 4 and 5 are each a cross-sectional view of a main part of another embodiment of the live tank type gas circuit breaker according to the present invention.

It is known that, to restrict the surge voltage upon closing circuit, the two closing-resistor devices are electrically connected in two steps in parallel with the main interrupting unit so that the closing resistor devices are connected one by one so as to change, in a stepwise fashion, the resistor value of the devices in parallel with the main interrupting unit 4. In order to apply this method to the construction of FIG. 2, it is necessary to remove the end lid 12 and connect the equivalent to the closing resistor device 5 to the hollow bearing 8*b*. As is obvious from the above description, it is advantageous that the center shaft 11 be provided at both ends with engaging portions to be engaged with the rotating shaft 31 whether the closing resistor device 5 is present or absent and the center shaft be supported by the two hollow bearings 8*a* and 8*b*. This fact is applicable in other cases than the above described two-step resistor connecting method. For example, the end lid 12 is removed away and a conduit 54 can be fixed to the mechanism housing 3 as shown in FIG. 4. A porcelain tube 56 can be secured to a flange 55 of the conduit 54 and capacitor elements 57 can be placed in the tube 56 with the voltage grading capacitor device 6 being fixed. Since gas can be communicated to the inside of the tube 56 through the conduit 54 and the hollow bearing 8*b* from the inside of the mechanism casing 3, gas can be filled in the housing 3 and tube 56, simultaneously. Alternately, the voltage grading capacitor device 6 can be mechanically fixed to the housing 3, and the housing 3 and tube 56 can be connected by pipe or the like to permit gas to communicate therebetween.

Figure 5:
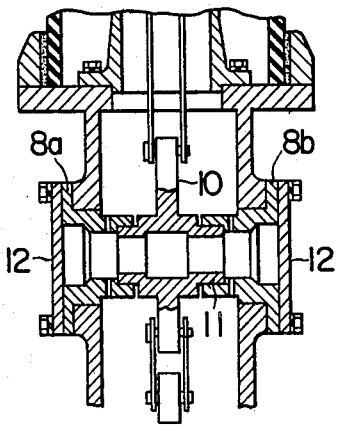

FIG. 5 shows another embodiment as a main part of a gas circuit breaker with no closing resistor device and no voltage grading capacitor device. This embodiment is the same as the previous one in that the center shaft 11 of the L-shaped lever 10 is supported by the two hollow bearings 8*a* and 8*b*, but different in that both hollow bearings 8*a* and 8*b* are sealed airtight by the end lids 12. It will be understood from the embodiment that the main interrupting units 4 and the housing 3 can be the same in their inner structure whether the closing resistor device 5 is present or absent.

While the embodiments as mentioned above are live tank type gas circuit breakers, the present invention can be used for dead tank type gas circuit breakers. For example, the porcelain tubes 29, 47 and 56 in FIG. 4 can be replaced by insulating cylinders of resin, and all parts can be housed in a tank with the casing 3 being supported to be electrically insulated from the tank by an insulating supporting member. In this case, the insulating cylinder corresponding to the porcelain tube 29 can be omitted and the end lid 12 shown in FIG. 1 can be removed.

We claim:

1. A gas circuit breaker comprising:

a swingable lever means for forming a portion of an operation force transmitting mechanism;

a mechanism housing means for housing the swingable lever means;

a center shaft means for supporting said lever means in said mechanism housing means;

a main interrupting unit supported by said mechanism housing means, the main interrupting unit including a moving contact connected to one end of said swingable lever means;

an operation means for exerting an operating force on said lever means so as to enable the lever means to open and close the main interrupting unit;

hollow bearing means for slidably supporting at least one end of the center shaft means, said hollow bearing means being securely engaged in an aperture provided in said mechanism housing means, said center shaft means being positioned in a hollow space of said hollow bearing means and having an engaging means at said one end for enabling an engagement with a force transmitting member; and a gas filled in said mechanism housing means and said main interrupting unit for enabling an extinction of an arc in the circuit breaker; and at least one end lid means removably attached to said hollow bearing means for sealing at least one end of said hollow space of said hollow bearing means.

2. A gas circuit breaker according to claim 1, wherein said center shaft means of said lever means is supported at both ends by the hollow bearing means, and wherein the hollow spaces of both of said hollow bearing means are sealed by the end lid means.

3. A gas circuit breaker comprising:

a swingable lever means for forming a portion of an operation force transmitting mechanism;

a mechanism housing means for housing the swingable lever means;

a center shaft means for supporting said lever means in said mechanism housing means;

a main interrupting unit supported by said mechanism housing means, the main interrupting unit including a moving contact connected to one end of said swingable lever means;

an operation means for exerting an operating force on said lever means so as to enable the lever means to open and close the main interrupting unit;

a hollow bearing means engaged in an aperture of said mechanism housing means for slidably supporting at least one end of said lever means;

a means for communicating an interior of said mechanism housing means and a hollow space of said hollow bearing means;

an engaging means formed at one end of the center shaft means positioned in the hollow space of said hollow bearing means for enabling an engagement with a force transmitting member;

a gas filled in said mechanism housing means and said main interrupting unit for enabling an extinction of an arc in the circuit breaker; and at least one end lid means removably attached to said hollow bearing means for sealing at least one end of the hollow space of said hollow bearing means.

4. A gas circuit breaker comprising:

a swingable lever means for forming a portion of an operation force transmitting mechanism;

a mechanism housing means for housing the swingable lever means;

a center shaft means for supporting said lever means in said mechanism housing means;

a main interrupting unit supported by said mechanism housing means, the main interrupting unit including a moving contact connected to a first end of said swingable lever means;

an operating means for exerting an operating force on a second end of said lever means;

a hollow bearing means engaged in an aperture bored through said mechanism housing means for slidably supporting at least one end of said lever means;

an engaging means formed at one end of the center shaft means of said lever means positioned in a hollow space of said hollow bearing means;

a rotating shaft means having a first engaged with said engaging means so as to transmit an operation of the center shaft means of said lever means;

a second mechanism housing means having a bearing means for supporting a second end of said rotating shaft means, said second mechanism housing means being adapted to be fastened to the first mentioned mechanism housing means;

a gas filled in said mechanism housing means and said said main interrupting unit for enabling an extinction of an arc in the circuit breaker; and a closing resistor means having a moving resistor contact connected to the second end of said rotating shaft means.

5. A gas circuit breaker comprising:

a main interrupting unit having at least a pair of fixed contacts placed in a porcelain tube and a moving contact;

a lever means having a first end connected to said moving contact and a second end connected to an operating means;

a mechanism housing means for housing said lever means;

a center shaft means for supporting said lever means in said mechanism housing means;

means provided in said mechanism housing means for communicating the mechanism housing means with an interior of said porcelain tube;

a hollow bearing means engaged in an aperture bore through said mechanism housing means with an airtightness being maintained for slidably supporting at least one end of the center shaft means of said lever means;

a means for communicating a hollow space of said hollow bearing means with an interior of said mechanism housing means;

a second mechanism housing means adapted to be connected to the first mentioned mechanism housing means;

tube means for communicating the hollow space of said hollow bearing means with an interior of the second mechanism housing means;

a rotating shaft means disposed in said tube means, the rotating shaft means has a first end engaged with the center shaft means so as to be rotated thereby and a second end slidably supported in said second mechanism housing means;

a gas filled in both of said mechanism housing means and said main interrupting unit for enabling an extinction of an arc in the circuit breaker; and a closing resistor means connected to the second end of said rotating shaft means, the closing resistor means includes a moving resistor contact operated by a rotation of said rotating shaft means which is moved by said lever means.

6. A gas circuit breaker according to claim 5, further comprising a voltage graded capacitor means adapted to be electrically connected in parallel with said main interrupting unit, the voltage graded capacitor means includes a porcelain tube, and wherein hollow bearing means are provided for slidably supporting both ends of the center shaft means, and a conduit means is provided for communicating with said hollow bearing means at the second end of said center shaft means, said conduit means is adapted to permit gas to be continously communicated to said mechanism housing means and to enable said mechanism housing means to be connected to the porcelain tube of the voltage grading capacitor means.

7. A gas circuit breaker according to claim 5, wherein said closing resistor means further comprises a porcelain tube which communicates with and is supported by said second mechanism housing means, a fixed side resistor contact disposed opposite to said moving resistor contact, a plurality of stacked resistors with one end of the stack being connected to said fixed-side resistor contact, means for electrically connecting a series of said both resistor contacts and the closing resistor means in parallel with said main interrupting unit, and means are provided for delaying a restoration of said fixed-side resistor contact upon an opening of said moving contact.

* * * * *